US005555605A

United States Patent [19]

Mosher

[11] Patent Number: 5,555,605

[45] Date of Patent: Sep. 17, 1996

[54] DOOR HINGE ALIGNMENT APPARATUS

[76] Inventor: Gary M. Mosher, 9301 S. 234th St., Gretna, Nebr. 68028

[21] Appl. No.: 543,817

[22] Filed: Oct. 16, 1995

[51] Int. Cl.[6] ..... E05D 7/04

[52] U.S. Cl. ..... 16/247; 16/245; 16/238

[58] Field of Search ..... 16/247, 248, 246, 16/245, 235, 238, 287, DIG. 39, DIG. 43

[56] References Cited

U.S. PATENT DOCUMENTS

| | | | |
|---|---|---|---|
| 2,591,979 | 4/1952 | Turley | 16/238 |
| 3,183,547 | 5/1965 | Bury | 16/238 |
| 4,881,296 | 11/1989 | Marinoni | 16/248 |
| 5,339,493 | 8/1994 | MacIntyre | 16/238 |

*Primary Examiner*—Chuck Y. Mah

*Attorney, Agent, or Firm*—John A. Beehner Law Office

[57] ABSTRACT

An apparatus and method for aligning a door includes a door plate and a jamb plate hingedly connected to the door plate. A backing plate is spaced from and adjustably connected to the jamb plate, the backing plate including an adjustable spacing device for adjusting the distance between a door frame member and the door jamb to which the alignment apparatus is mounted. The jamb plate and backing plate are adapted to be mounted on a door jamb such that the door jamb is positioned between the jamb plate and backing plate. An adjustable fastening device extends from the jamb plate through the door jamb and backing plate into an adjacent door frame member for securing the alignment apparatus on a door frame member. Adjustment of the distance between the door frame member and door jamb is effected by adjustment of the adjustable spacing device.

10 Claims, 4 Drawing Sheets

DOOR HINGE ALIGNMENT APPARATUS

BACKGROUND OF THE INVENTION

1. Technical Field

This invention relates to door hinges and, more particularly, to a door hinge alignment apparatus adapted to be mounted on the inner and outer sides of a door jamb, the apparatus further including an adjustable spacing device for increasing or decreasing the distance between the door jamb and the door frame member, thus enabling efficient adjustment of the door swing.

2. Description of the Prior Art

Doors are usually hung using at least two hinges. A standard hinge includes two hinge leaves, which are commonly flat metal plates, each hinge leaf including one or more cylinders adapted to interfit with the cylinders on the opposite leaf such that a hinge pin may be slid down the center of the cylinders to secure the hinge leaves to one another. One of the hinge leaves is then secured to the door jamb while the opposite hinge leaf is secured to the door, thus allowing the door to pivot about the hinge pin in the hinge.

While a standard hinge as described above is useful in many door-hanging situations, several problems encountered in hanging doors cannot be addressed by using the standard hinge. Most importantly, the standard hinge does not provide any means by which adjustment of the door swing may be effected. Adjustments to the door hinge alignment are mandated by swelling, shrinking or warping of the door frame member or door jamb to which the hinge is connected. Warping of the door frame may also be caused by settling of the foundation in newer houses. There is therefore a need for a door hinge alignment apparatus which is capable of slight adjustment of the door swing position.

Several examples have been proposed in the prior art which attempt to address this problem. For example, Von de Marwitz, U.S. Pat. No. 880,317, discusses an adjustable door hinge having a filling plate between the hinge leaf and the jamb or casing. Adjustment screws are provided for adjusting the relative distance between the filling plate and the hinge leaf to bring the door into proper registry with the framework casing. However, Von de Marwitz is mounted directly to the jamb or casing, and any adjustment of the hinge is done with respect to the jamb, which itself is not adjusted relative to the door frame. Therefore, the alignment of the jamb with respect to the stud on which the door is mounted cannot be adjusted. Also, when the hinge leaf is moved outwards from the filling plate, an unsightly gap is formed between the hinge leaf and the filling plate which may detract visually from the door aesthetics. Furthermore, Von de Marwitz supports the door by only two screws which are attached to the filling plate, which results in the door being mounted less sturdily.

Another example of those devices found in the prior art which attempt to address the problem of adjusting the swing of a door is disclosed in Cole et al., 3,774,345, which discloses a door casing assembly enabling adjustable mounting of hinge leaves. A channel is provided for mounting and supporting a plurality of hinge leaf mounting plates. The hinge leaf mounting plates can be loosened and moved to accommodate sagging, wear or minor building damage. Again, however, similar to Von de Marwitz, Cole does not provide for adjustment between the casing and stud but merely only on top of the door jamb or casing. There is therefore a need for a door hinge alignment apparatus which will adjust the door swing relative to the door frame member to which the door is mounted, while simultaneously providing for adjustment of the door jamb to preserve the aesthetic appearance of the door opening.

Therefore, an object of the present invention is to provide an improved door hinge alignment apparatus.

Another object of the present invention is to provide a door hinge alignment apparatus which includes a door plate, a generally flat jamb plate hingedly connected to the door plate, a generally flat backing plate spaced from and adjustably connected to the jamb plate and generally parallel therewith and an adjustable spacing device mounted on the backing plate for adjusting the distance between the door frame member and the door jamb.

Another object of the present invention is to provide a door hinge alignment apparatus which provides for adjustment of the swing of the door and adjustment of the door jamb relative to the door frame member to which the door jamb is mounted.

Another object of the present invention is to provide a door hinge alignment apparatus in which the jamb plate is positioned on the outer surface of the door jamb and the backing plate is mounted behind the door jamb such that the door jamb is sandwiched between the jamb plate and backing plate of the alignment apparatus.

Another object of the present invention is to provide a method of aligning a door which includes the steps of providing the apparatus described above, mounting the jamb plate on the door side of the door jamb, mounting the backing plate on the door frame member side of the door jamb generally parallel with the jamb plate, fastening the jamb plate to the door frame member and adjusting the distance between the door jamb and the door frame member through adjustment of the adjustable spacing means.

Another object of the present invention is to provide a door hinge alignment apparatus which may be easily and quickly adjusted to modify the swing of a door to accommodate settling of the door frame or warping of the wood therein.

Finally, an object of the present invention is to provide a door hinge alignment apparatus and method which is relatively simple in construction, relatively simple to install and is safe and efficient in use.

SUMMARY OF THE INVENTION

The present invention provides a door hinge alignment apparatus for swingably mounting a door on a door frame member and a door jamb spaced from the door frame member and having a door frame member side facing the door frame member and an opposite door side, the apparatus including a door plate for connection to a door and a generally flat jamb plate having at least one fastening hole, the jamb plate hingedly connected to the door plate. A generally flat backing plate is spaced from and adjustably connected to the jamb plate, the backing plate including at least one fastening hole and the backing plate positioned generally parallel with the jamb plate. An adjustable spacing device such as a screw is adjustably mounted on the backing plate for adjusting the distance between the door frame member and the door jamb. The jamb plate and backing plate are adapted to be mounted to the door side and door frame member side, respectively, of the door jamb such that the door jamb is positioned between the jamb plate and the backing plate and the fastening holes of the jamb plate and the backing plate are generally aligned. Finally, an adjustable fastening device such as a plurality of wood screws extends through the generally aligned fastening holes in the jamb plate and the backing plate for adjustable fastening of the jamb plate and backing plate to the door frame member.

The present invention further contemplates a method of aligning a door including a door frame member and a door jamb spaced from the door frame member and having a door frame side facing the door frame member and an opposite door side, the method including the steps of providing a door plate, a generally flat jamb plate having at least one fastening hole, the jamb plate hingedly connected to the door plate, a generally flat backing plate having at least one fastening hole, an adjustable spacing device mounted on the backing plate and an adjustable fastening device. The jamb plate is mounted on the door side of the door jamb and the backing plate is mounted on the door frame member side of the door jamb generally parallel with the jamb plate such that the door jamb is secured between the jamb plate and the backing plate and the fastening holes of the jamb plate and the backing plate are generally aligned. The jamb plate is then fastened to the door frame member by the adjustable fastening device, which is preferably a plurality of wood screws. The door plate is then mounted to a door thereby swingably hanging the door and the distance between the door jamb and the door frame member is adjusted through adjustment of the adjustable spacing device, thereby adjusting the hanging position of the door and the position of the door jamb relative to the door frame member.

As can be seen by the above description, the apparatus and method of the present invention provides a substantial improvement over those devices and methods found in the prior art. For example, because the jamb plate is directly mounted to the door jamb and door frame member, the door is much more securely fastened in swinging position thus resulting in increased security. Also, because the backing plate is mounted behind the door jamb, the door jamb is secured between the jamb and backing plate thus enabling the position of the door jamb with respect to the door frame member to be adjusted. Finally, the method of the present invention allows for simple and quick adjustment of the hanging position of the door relative to the door frame member which also includes adjustment of the position of the door jamb such that the edge of the door to which the hinge is connected remains in line with the door jamb, thus effecting a better seal between the door jamb and door. The present invention is thus seen to provide numerous advantages over those devices and methods found in the prior art.

DESCRIPTION OF THE PREFERRED EMBODIMENT

Figure 1:
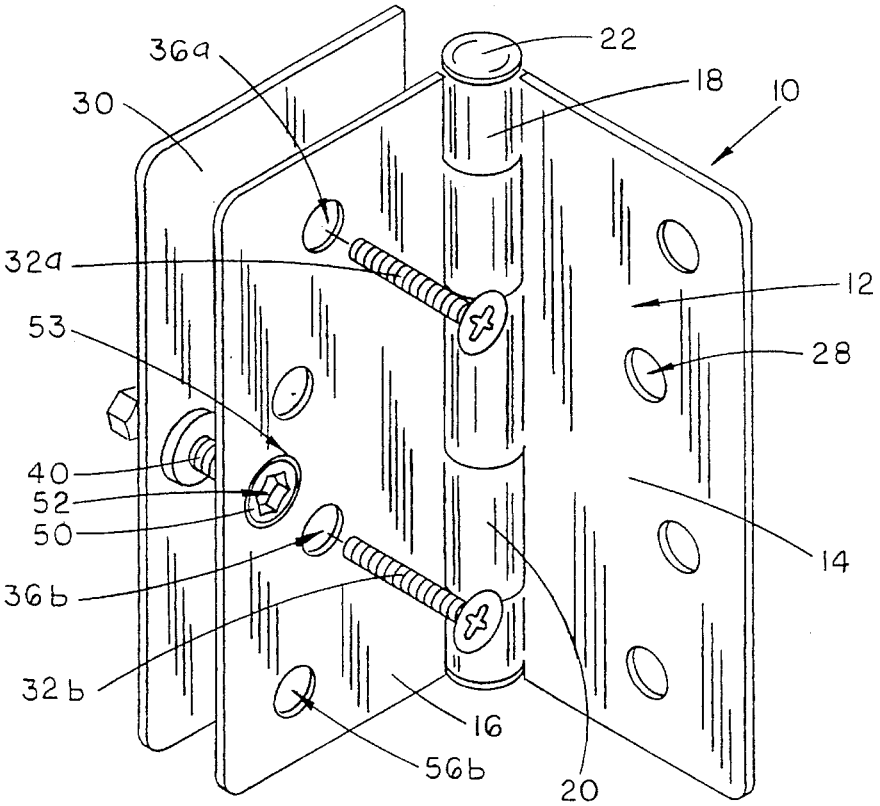
FIG. 1 is a perspective view of the door hinge alignment apparatus of the present invention.

The door hinge alignment apparatus 10 is best shown in FIGS. 1–4 as including a hinge 12 having a door plate 14 and a jamb plate 16. Door plate 14 further includes a plurality of hinge pin sleeves 18 which interfit with hinge pin sleeves 20 on jamb plate 16 to allow a hinge pin 22 to extend through the aligned sleeves 18 and 20 thus hingedly connecting door plate 14 and jamb plate 16 as shown in FIG. 1 substantially similar to a standard-type hinge. The door plate 14 is secured to a door 24 by a plurality of wood screws 26 extending through mounting holes 28 formed in the door plate 14.

It is preferred that door plate 14 and jamb plate 16 have approximately similar dimensions, which in a preferred embodiment would be approximately 4 inches in height and 2–3 inches in width. It is also preferred that the door plate 14 and jamb plate 16 be constructed of high-tensile strength steel to properly support a door 24 thereon. Of course, the size, shape and construction materials used to form the door hinge alignment apparatus 10 of the present invention may be varied.

Figure 2:
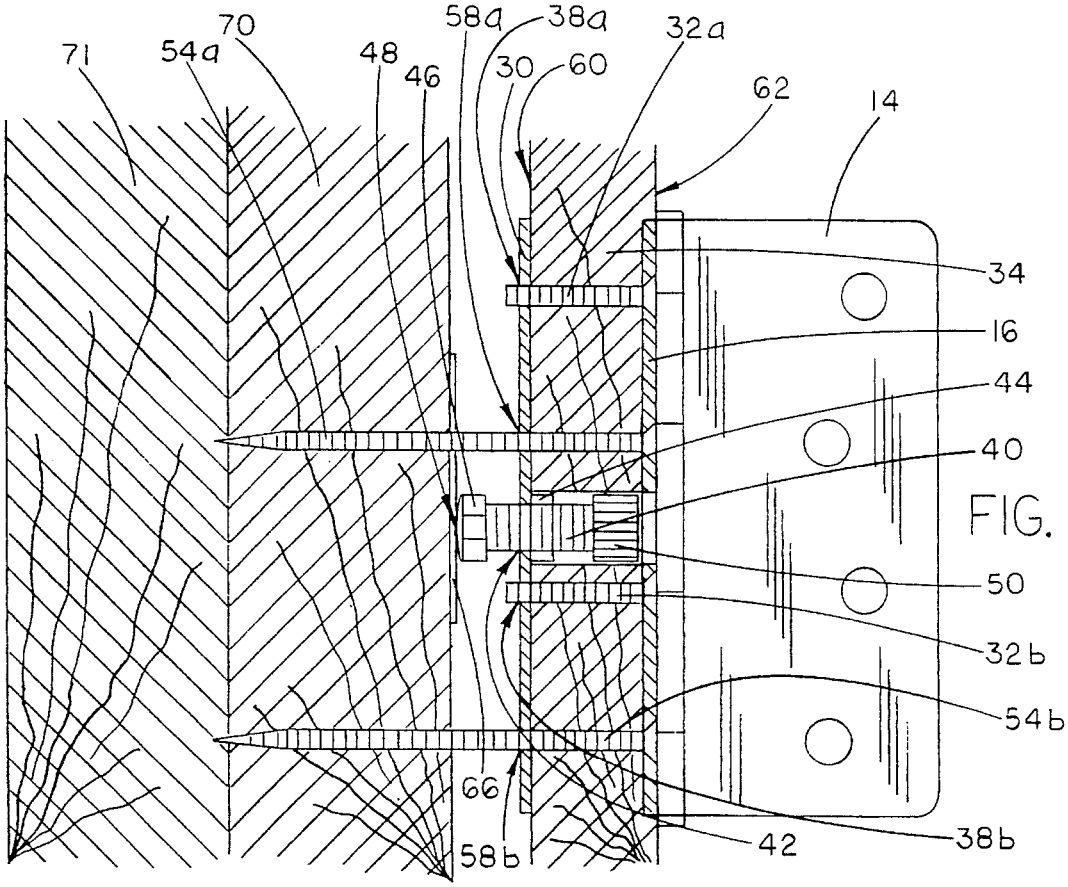
FIG. 2 is a side sectional elevational view of the present invention mounted on a door jamb.
Figure 3:
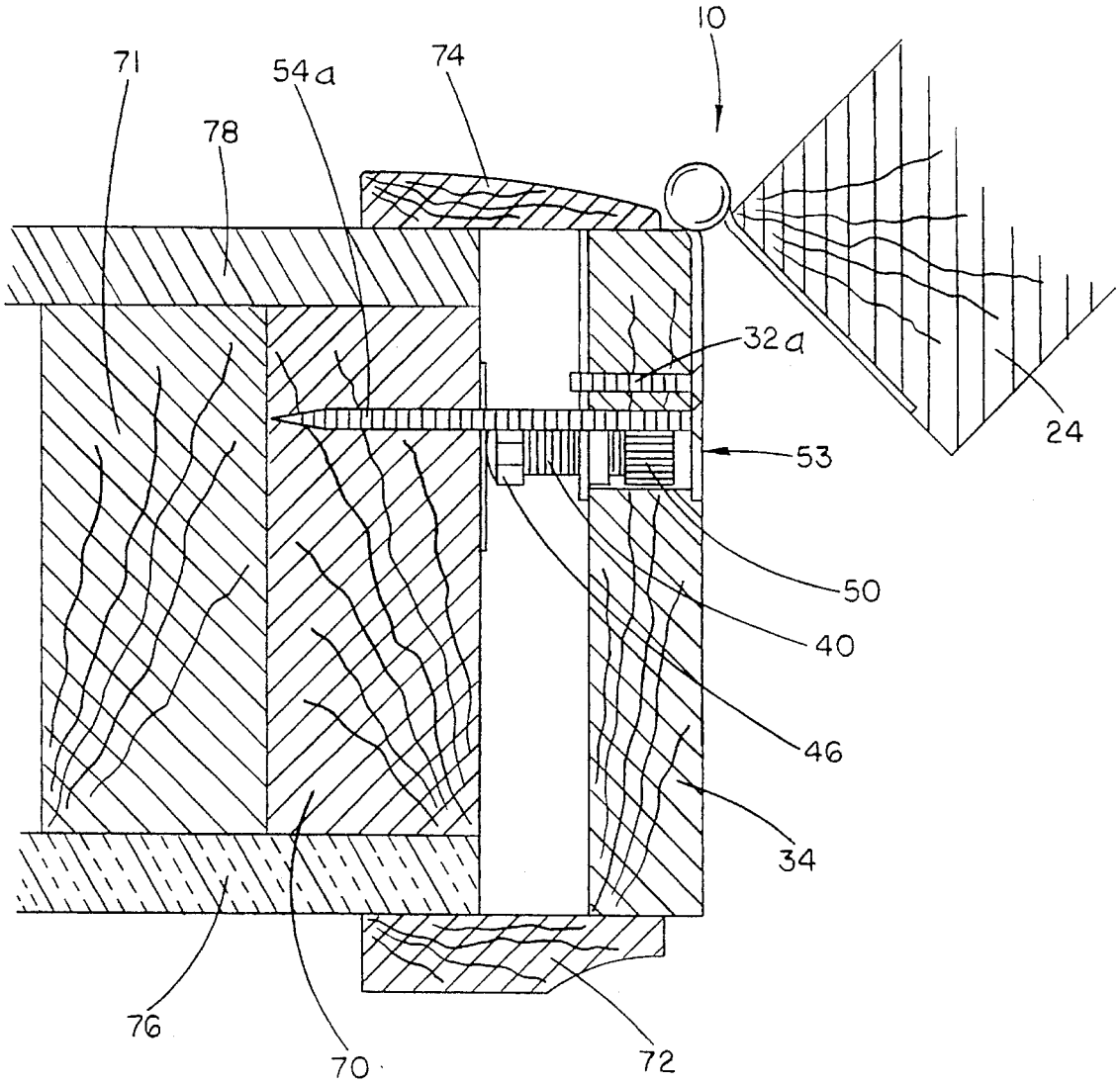
FIG. 3 is a top plan view of the present invention mounted on a door jamb.

Adjustably connected to jamb plate 16 is a backing plate 30, connection between the backing plate 30 and jamb plate 16 effected by a pair of metal screws **32*a* and 32*b*, as shown in FIGS. 1 and 2. As shown in FIG. 1, the backing plate 30 and jamb plate 16 are preferably generally parallel with one another and spaced apart such that a door jamb 34 may be positioned between the backing plate 30 and jamb plate 16, as shown in FIG. 2. Metal screws 32*a* and 32*b* extend through connection holes 36*a* and 36*b* formed in jamb plate 16 and are threadably received by threaded connection holes 38*a* and 38*b* in backing plate Adjustably mounted on backing plate 30 is a spacing screw 40 which is preferably a threaded metal screw. Backing plate 30 may include a threaded spacing screw hole (not shown) or, alternatively, may include a threaded nut 44 mounted concentrically with spacing screw hole 42, threaded nut 44 being rigidly mounted on the backing plate 30 such that spacing screw 40 is threadably connected to the backing plate 30. Spacing screw 40 further includes an engagement head 46 mounted on the end of the spacing screw 40 adjacent the framing member 70, as shown best in FIG. 2. The engagement head 46 is preferably a standard carriage bolt head, except that it is preferred that the bearing surface 48 of the engagement head 46 be slightly rounded to prevent grinding of the framing member 70 when the spacing screw 40 is rotated. It is preferred that an engagement plate 66 be affixed to the framing member 70, as shown in FIG. 2, to prevent grinding of the framing member 70. Mounted on the opposite end of the spacing screw 40 adjacent the jamb plate 16 is an Allen wrench head 50 formed to accept an Allen wrench therein to adjust the spacing screw 40. To accommodate an Allen wrench, Allen wrench head 50 includes a generally hexagonal well 52, as best shown in FIG. 1. To allow access to the Allen wrench head 50, jamb plate 16 includes a head access hole 53 generally aligned with the spacing screw 40. An Allen wrench may be extended through head access hole 53 and inserted into well 52 for rotation of Allen wrench head 50**.

Finally, for securing jamb plate 16 to framing member 70, a pair of wood screws **54*a* and 54*b* extend through securement holes 56*a* and 56*b* formed in jamb plate 16, through screw holes 58*a* and 58*b* formed in backing plate 30 and into framing member 70, thereby securing jamb plate 16 to framing member 70, as shown in FIGS. 1 and 2. It is preferred that wood screws 54*a* and 54*b* be approximately 3–4 inches long to sufficiently extend into framing member 70 for securement of jamb plate 16 thereon. Second framing member 71** is shown to point out that commonly two framing members form the door frame structure.

The door hinge alignment apparatus 10 is mounted in the following manner. Jamb plate 16 is positioned in a desired location on door jamb 34 and the positions for connection holes 36*a* and 36, securement holes 56*a* and 56*b* and head access hole 53 are marked. Holes must then be drilled in door jamb 34 to allow metal screws 32*a* and 32*b* to extend through door jamb 34 and to allow spacing screw 40 to extend through door jamb 34. However, holes need not be drilled for wood screws 54*a* and 54*b*, as these may be extended through door jamb 34 in the normal manner of wood screws. Following drilling of the holes through door jamb 34, backing plate 30 is generally aligned with jamb plate 16 such that jamb plate 16 and backing plate 30 are on opposite sides of the door jamb 34, specifically the backing plate 30 mounted on the door frame member side 60 of door jamb 34 and jamb plate 16 mounted on the door side 62 of door jamb 34. Threaded connection holes 38*a* and 38*b* are then aligned with connection holes 36*a* and 36*b* such that metal screws 32*a* and 32*b* may extend between the jamb plate 16 and backing plate 30 and be threadably received by threaded connection holes 38*a* and 38*b*. Tightening of the metal screws 32*a* and 32*b* thus results in securement of the jamb plate 16 and backing plate 30 in desired position on the door jamb 34. The jamb plate 16 is then secured to framing member 70 by wood screws 54*a* and 54*b* which extend through securement holes 56*a* and 56*b*, through door jamb 34, through screw holes 58*a* and 58*b* and into framing member 70, as shown in FIGS. 2 and 4.

The distance between backing plate 30 and framing member 70 is adjusted by means of the spacing screw 40 and wood screws 54*a* and 54*b*. Wood screws 54*a* and 54*b* act to secure door jamb 34 to framing member 70, while spacing screw 40 prevents door jamb 34 from contacting framing member 70 in response to tightening of wood screws 54*a* and 54*b*. It is preferred that when door hinge alignment apparatus 10 is in place on door jamb 34, Allen wrench head 50 mounted on spacing screw 40 is positioned slightly inside of jamb plate 16 such that Allen wrench head 50 does not interfere with the closing of hinge 12. Therefore, when wood screws 54*a* and 54*b* are tightened, engagement head 46 contacts framing member 70 at a predetermined distance, the distance being determined by the location of the Allen wrench head 50 with respect to the jamb plate 16, as discussed above.

Once the door hinge alignment apparatus 10 is mounted on the door jamb 34 and the framing member 70, the door 24 may be hung on the door plate 14 of hinge 12 by use of wood screws 26 extending through mounting holes 28, as previously discussed. Once door 24 is hung on the door hinge alignment apparatus 10, the benefits of the present invention become immediately apparent. Specifically, if the door 24 is not hung correctly (i.e., the edges of the door contact the surrounding frame or floor), the present invention allows for rapid and simple adjustment of the hanging position of the door. For example, a standard door would have at least two hinges connected thereto, one adjacent the top of the door and one adjacent the bottom of the door. If the outer end of the base of the door were contacting the ground, for example, adjustment of the hanging of the door would be performed in the following manner. The original location of the top hinge, shown in FIG. 3, would need to be adjusted inwards to bring the base of the door out of contact with the floor. Therefore, an Allen wrench would engage Allen wrench head 50 of spacing screw 40, spacing screw 40 then being rotated counterclockwise to reduce the length of spacing screw 40 extending between engagement head 46 and threaded nut 44 as shown in FIG. 4. Wood screws 54*a* and 54*b* would then be tightened to draw door jamb 34 and jamb plate 16 towards framing member 70, thus properly aligning the door with the door frame. FIG. 4 shows the newly adjusted hinge of FIG. 3, wherein the distance between door jamb 34 and framing member 70 has been reduced.

Figure 4:
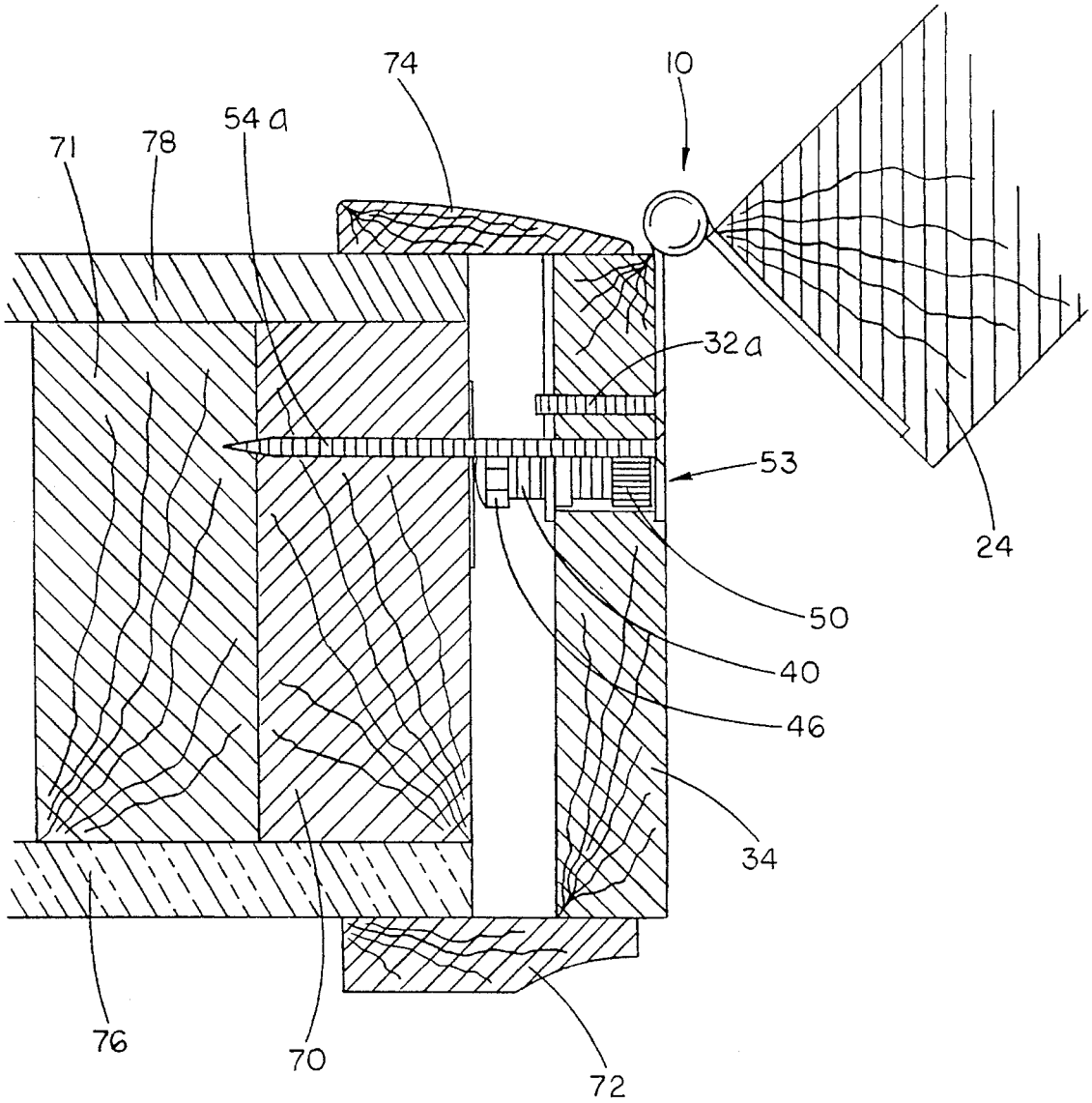
FIG. 4 is a top plan view of the present invention mounted on a door jamb as in FIG. 3, but showing adjustment of the spacing screw.
Figure 5:
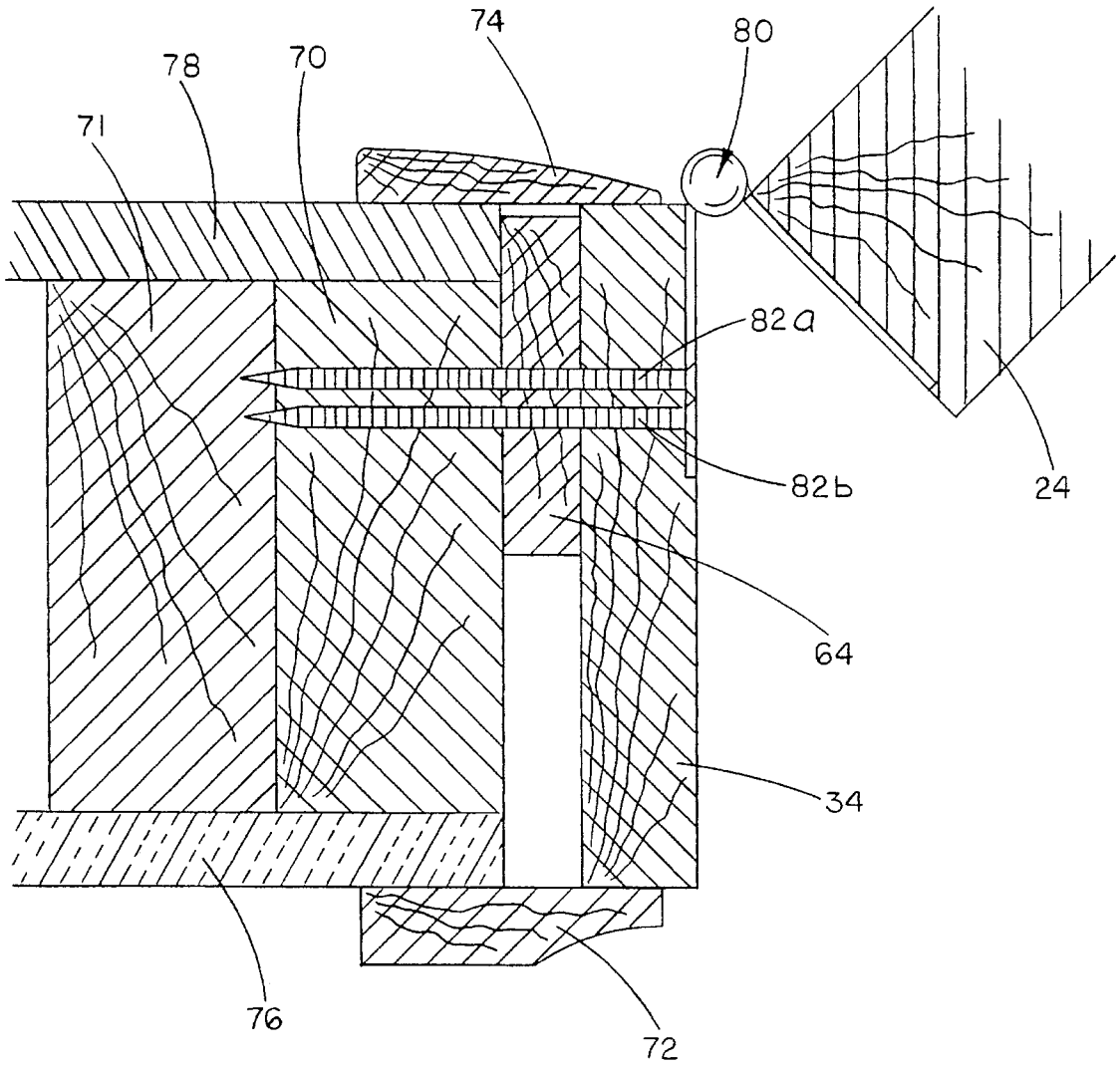
FIG. 5 (PRIOR ART)
FIG. 5 is a top plan view of a standard hinge found in the prior art.

FIG. 4 shows how the brick mould 72 and casing 74 extend between drywall sections 76 and 78 and door jamb 34. Minor movement of door jamb 34 relative to framing member 70 and drywall sections 76 and 78 is thus concealed, due to the overlapping nature of casing 74 and brick mould 72. It is intended that the present invention allow for adjustment of the door jamb in only a limited fashion, as the nails which secure the casing 74 and brick mould 72 to the door jamb 34 will only allow for limited adjustment. Therefore, it is preferred that the adjustment capabilities of the present invention be no more than ⅛ of an inch inwards towards framing member 70 or outwards away from framing member 70. 0f course, the preferred range of movement should not be understood to limit the present invention, as modification of the standard door frame would allow for greater adjustment of the door jamb 34 with respect to the framing member FIG. 5 illustrates an example of a hinge found in the prior art. FIG. 5 is provided to show that spacing screw 40 of the present invention is intended to adjustably replace wood spacer bar 64, which is present in an ordinary door frame. FIG. 5 is also provided to show that the adjustment of the position of a conventional door hinge can be exceedingly difficult. For example, the position of hinge 80 in FIG. 5 would be adjusted in the following manner: first, wood screws 82*a* and 82*b* must be removed and the door 24 and hinge 80 removed from the door jamb 34. Next, brick mould 72 and casing 74 must be removed from the door jamb 34 to permit access to the wood spacer bar 64. One or more washers or shims (not shown) must then be inserted between the wood spacer bar 64 and door jamb 34 to change the location of the hinge 80 relative to the framing member 70. Following attachment of the washers to the wood spacer bar 64, door jamb 34 is remounted on wood spacer bar 64, brick mould 72 and casing 74 are reattached to door jamb 34 and hinge 80 is rehung on door jamb 34 by insertion of screws and 82*b*. Compare this long, tedious and inaccurate method of adjusting the hanging of a door with the adjustment capabilities of the door hinge alignment apparatus of the present invention. It is thus seen that the present invention provides a substantial improvement over those devices found in the prior art, particularly ordinary door hinges.

It is to be understood that numerous modifications, additions and substitutions may be made to the preferred embodiment described and shown above which fall within the intended broad scope of the appended claims. For example, the number of screws used to secure jamb plate 16 and backing plate 30 to one another may be varied, as may the number of wood screws used to secure jamb plate 16 to framing member 70. Additionally, the spacing screw 40 may be replaced by any appropriate adjustable spacing device, so long as access to the spacing device is permitted without removing jamb plate 16 or door jamb 34 from connection with framing member 70.

There has thus been set forth and described an invention which accomplishes at least all of the stated objectives.

I claim:

1. A door hinge alignment apparatus for swingably mounting a door on a door frame member and a door jamb spaced from the door frame member and having a door frame member side facing the door frame member and an opposite door side, said apparatus comprising;

a door plate for connection to a door;

a generally flat jamb plate having at least one fastening hole, said jamb plate hingedly connected to said door plate;

a generally flat backing plate spaced from and adjustably connected to said jamb plate and having at least one fastening hole, said backing plate generally parallel with said jamb plate;

adjustable spacing means mounted on said backing plate for adjusting the distance between the door frame member and the door jamb;

said jamb plate and said backing plate adapted to be mounted to the door side and door frame member side, respectively, of the door jamb such that the door jamb is positioned between said jamb plate and said backing plate and said fastening holes of said jamb plate and said backing plate are generally aligned; and adjustable fastening means extending through said generally aligned fastening holes in said jamb plate and said backing plate for adjustable fastening of said jamb plate and said backing plate to the door frame member.

2. The door hinge alignment apparatus of claim 1 wherein said door plate, said jamb plate and said backing plate each comprise a generally rectangular metal sheet, said door plate and said jamb plate each further including a plurality of hinge pin sleeves, said hinge pin sleeves on said door plate interfitting with said hinge pin sleeves on said jamb plate such that a hinge pin may be inserted through said interfitted hinge pin sleeves thereby hingedly connecting said door plate and said jamb plate.

3. The door hinge alignment apparatus of claim 1 wherein said adjustable spacing means comprises a spacing screw threadably mounted on said backing plate, said spacing screw including an engagement head mounted at one end of said spacing screw intermediate said backing plate and the door frame member and a wrench head mounted on the opposite end of said spacing screw such that rotation of said wrench head rotates said spacing screw thereby extending and retracting said engagement head relative to said backing plate.

4. The door hinge alignment apparatus of claim 3 further comprising an engagement plate adapted to be mounted on a door frame member to prevent grinding of the door frame member in response to rotating engagement of the door frame member by said engagement head of said spacing screw.

5. The door hinge alignment apparatus of claim 4 wherein said jamb plate further includes a spacing screw hole generally aligned with said spacing screw and allowing access to said wrench head such that rotation of said spacing screw may be performed with said jamb plate and said backing plate mounted on a door jamb.

6. The door hinge alignment apparatus of claim 1 wherein said adjustable fastening means comprises at least one wood screw extending through said fastening holes in said jamb plate and said backing plate and being threadably inserted into a door frame member for securement of said door hinge alignment apparatus on a door frame member.

7. A method of aligning a door including a door frame member and a door jamb spaced from the door frame member and having a door frame member side facing the door frame member and an opposite door side, said method comprising the steps;

providing a door hinge alignment apparatus including a door plate, a generally flat jamb plate having at least one fastening hole, said jamb plate hingedly connected to said door plate, a generally flat backing plate having at least one fastening hole, adjustable spacing means mounted on said backing plate and adjustable fastening means;

mounting said jamb plate on the door side of the door jamb;

mounting said backing plate on the door frame member side of the door jamb generally parallel with said jamb plate such that the door jamb is secured between said jamb plate and said backing plate and said fastening holes of said jamb plate and said backing plate are generally aligned;

fastening said jamb plate to the door frame member by said adjustable fastening means;

mounting said door plate to a door thereby swingably hanging the door; and adjusting the distance between the door jamb and the door frame member through adjustment of said adjustable spacing means thereby adjusting the hanging position of the door and the position of the door jamb.

8. The method of claim 7 wherein said step of providing adjustable spacing means further comprises providing a spacing screw having inner and outer ends and being threadably mounted on said backing plate, said spacing screw including an engagement head mounted on said inner end of said spacing screw intermediate said backing plate and the door frame member to which the door hinge alignment apparatus is to be mounted and a wrench head mounted on said outer end of said spacing screw such that rotation of said wrench head rotates said spacing screw thereby extending and retracting said engagement head relative to said backing plate.

9. The method of claim 8 wherein said step of providing adjustable fastening means further comprises providing wood screws extending through said jamb plate, through said backing plate and threadably engaging a door frame member to which the door hinge alignment apparatus is to be mounted.

10. The method of claim 9 wherein said step of adjusting the distance between the door jamb and the door frame member comprises rotating said spacing screw thereby alternatively extending and retracting said engagement head relative to said backing plate, thus alternatively increasing and decreasing the distance between the door jamb and the door frame member.

* * * * *